US008418499B2

(12) United States Patent
Jeong et al.

(10) Patent No.: US 8,418,499 B2
(45) Date of Patent: Apr. 16, 2013

(54) NATURAL GAS LIQUEFACTION SYSTEM WITH TURBINE EXPANDER AND LIQUEFACTION METHOD THEREOF

(75) Inventors: Sang Kwon Jeong, Daejeon (KR); Gyu Wan Hwang, Daejeon (KR); Seung Whan Baek, Jeollabuk-do (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 816 days.

(21) Appl. No.: 12/533,357

(22) Filed: Jul. 31, 2009

(65) Prior Publication Data

US 2010/0024475 A1 Feb. 4, 2010

(30) Foreign Application Priority Data

Jul. 31, 2008 (KR) ..... 10-2008-0075165

(51) Int. Cl.
*F25J 1/00* (2006.01)

(52) U.S. Cl.
USPC ..... 62/612

(58) Field of Classification Search ..... 62/600, 62/606, 611, 612, 613
See application file for complete search history.

(56) References Cited

U.S. PATENT DOCUMENTS

| | | | | |
|---|---|---|---|---|
| 4,094,655 | A * | 6/1978 | Krieger | 62/612 |
| 5,701,761 | A * | 12/1997 | Prevost et al. | 62/613 |
| 6,334,334 | B1 * | 1/2002 | Stockmann et al. | 62/612 |
| 6,438,994 | B1 * | 8/2002 | Rashad et al. | 62/613 |
| 7,386,996 | B2 * | 6/2008 | Fredheim et al. | 62/612 |
| 2004/0255617 | A1 * | 12/2004 | Paradowski | 62/612 |

* cited by examiner

*Primary Examiner* — Frantz Jules
*Assistant Examiner* — Webeshet Mengesha
(74) *Attorney, Agent, or Firm* — Baker & Hostetler LLP

(57) ABSTRACT

A natural gas liquefaction system with a turbine expander is provided that can improve the efficiency of the whole refrigeration cycle by using the turbine expander, instead of the throttling process that uses the conventional Joule-Thomson throttling valve that is used as a final throttling means in a conventional natural gas liquefaction system, and a liquefaction method thereof. The natural gas liquefaction cycle provided with the turbine expander of the present invention comprises a compressor 100, at least one vapor-liquid separator 300 or 310, a plurality of heat exchangers 200, 210, 220, 230 and 240, at least one Joule-Thomson throttling valves (below to be called JT valve) 400 and 410, a turbine expander 500, and connecting lines composed of plurality of pipes P1, P2, P3, P4, P5, P6 and P7 to connect these components.

2 Claims, 1 Drawing Sheet

NATURAL GAS LIQUEFACTION SYSTEM WITH TURBINE EXPANDER AND LIQUEFACTION METHOD THEREOF

CROSS-REFERENCE TO RELATED APPLICATIONS

This application claims priority to foreign Patent Application KR 10 2008 0075165, filed on Jul. 31, 2008, the disclosure of which is incorporated herein by reference in its entirety.

FIELD OF THE INVENTION

The present invention relates to a natural gas liquefaction system with a turbine expander, and specifically to a natural gas liquefaction system with a turbine expander that can improve the efficiency of the whole refrigeration cycle by using the turbine expander, instead of the throttling process that uses the conventional Joule-Thomson throttling valve that is used as a final throttling means in a conventional natural gas liquefaction system, and a liquefaction method thereof. In particular, the present invention relates a natural gas liquefaction system with a turbine expander for cooling natural gas by indirect heat exchange with the expanded refrigerant stream supplied from the turbine expander in which a refrigerant in a superheated state is flowed, and a liquefaction method thereof.

BACKGROUND OF THE INVENTION

In general, natural gas (NG) is liquefied into a form of liquefied natural gas (LNG) for the convenience of storage and transport, etc. A conventional natural gas liquefaction system using a mixed refrigerant that is mixed with one or more refrigerant such as hydrocarbon, HFC, etc, is depicted in FIG. 1 and comprises a compressor 12, a plurality of heat exchangers 41 to 44, at least one throttling valve 31 or 32, and at least one vapor-liquid separator 21 or 22. First, the mixed refrigerant 11 is compressed by the compressor 12, and the compressed refrigerant stream is supplied to a first vapor-liquid separator (below to be also called as 'a first phase separator') 21. The compressed refrigerant stream is separated into vapor phase and liquid phase refrigerant streams (i.e. vapor and liquid streams) in the first phase separator 21. The liquid-phase refrigerant (below to be also called as 'a liquid stream') is expanded to cold refrigerant through a first throttling valve 31 to become an expanded refrigerant stream, and the expanded refrigerant stream passes through the first heat exchanger 41 to cool a natural gas 13 and the vapor-phase refrigerant (below to be also called as 'a vapor stream') supplied from the first phase separator 21 by indirect heat exchange therewith, then it returns to the low-pressure portion of the compressor 12. Meanwhile, the vapor stream supplied from the first phase separator 21 is pre-cooled by the expanded refrigerant stream supplied from the first throttling valve 31 as it passes through the first heat exchanger 41 as described above, before it is supplied to the second vapor-liquid separator (below to be also called as 'a second phase separator') 22 to be again separated into vapor phase and liquid phase refrigerant streams.

The liquid stream supplied from the second phase separator 22 is expanded to cold refrigerant through a second throttling valve 32 in the same manner as the first throttling valve 31 to provide an expanded refrigerant stream. Then, the expanded refrigerant stream cools natural gas by indirect heat exchange as it passes through the third heat exchanger 43 and returns to the compressor 12 via the second and first heat exchanger 42 and 41 in sequence. Meanwhile, the vapor stream supplied from the second phase separator 22 is further pre-cooled as it passes through the third heat exchanger 43 as described above, before it is supplied to the Joule-Thomson throttling valve 33 for final expansion. The expanded refrigerant stream further cools the cooled natural gas that is flowed in through the third heat exchanger 43 as it passes through the fourth heat exchanger 44. After that, for regeneration of the remaining cold source, the refrigerant from the fourth heat exchanger 44 passes through the third, second and first heat exchangers 43, 42, and 41 in sequence to be indirectly heat exchanged to cool the above-mentioned vapor stream and natural gas, before it returns to the compressor 12. Briefly, natural gas 13 is cooled by indirect heat exchange with the expanded refrigerant stream as it passes through the fourth heat exchanger 44 to become liquefied natural gas 14.

However, the throttling process using the Joule-Thomson valve increases entropy due to embedded irreversibility and this becomes the main cause for decreasing the efficiency of the whole refrigeration cycle. Among several expansion processes, the throttling process of two-phase flow at the throttling valve 33 with lowest temperature occupies a large portion of efficiency loss.

SUMMARY OF THE INVENTION

Embodiments of the present invention advantageously provide a natural gas liquefaction system with a turbine expander that can improve the efficiency of the whole refrigeration cycle by using the turbine expander, instead of the throttling process that uses the conventional Joule-Thomson throttling valve that is used as a final throttling means in a conventional natural gas liquefaction system, and a liquefaction method thereof.

Additional embodiments of the present invention advantageously provide a natural gas liquefaction system with a turbine expander for cooling natural gas by indirect heat exchange with the expanded refrigerant stream supplied from the turbine expander in which a refrigerant in a superheated state is flowed, and a liquefaction method thereof.

In accordance with one aspect of the present invention, there is provided a liquefaction system for converting natural gas into liquefied natural gas by using mixed refrigerants, comprising: a compressor for providing a compressed refrigerant stream by compressing the mixed refrigerants; first and second phase separators for separating the compressed refrigerant stream transferred from the compressor into vapor phase and liquid phase refrigerant streams (i.e. vapor and liquid streams); a turbine expander for converting the vapor stream in a superheated state into an expanded-cold refrigerant stream; and a plurality of heat exchangers connected by connecting lines to the first and second phase separators, the turbine expander, a natural gas source and a liquefied natural gas tank so as to cool the natural gas by indirect heat exchange with the expanded refrigerant stream provided by the first and second phase separators and the turbine expander.

Preferably, the liquefaction system of the present invention further comprises first and second JT valves that provide expanded refrigerant stream by expanding liquid stream from the first and second phase separators, respectively.

Preferably, the expanded refrigerant stream converted to a low temperature by the first and second JT valves is supplied to one of the heat exchangers connected to the first and second JT valves so as to cool the natural gas by indirect heat exchange.

Preferably, the heat exchanger includes: a first heat exchanger which cools the natural gas supplied from the natural gas source and the vapor stream supplied from the first phase separator by indirect heat exchange with the expanded-cold refrigerant stream passed through the first JT valve; a second heat exchanger which further cools the cooled natural gas from the first heat exchanger by indirect heat exchange with the vapor stream supplied from the second phase separator; a third heat exchanger which further cools the cooled natural gas from the second heat exchanger by indirect heat exchange with the expanded-cold refrigerant stream passed through the second JT valve and the expanded refrigerant stream that is supplied from the turbine expander; a fourth heat exchanger which is arranged between the turbine expander and the third heat exchanger, and further cools the cooled natural gas from the third heat exchanger by indirect heat exchange with the expanded refrigerant stream supplied from the turbine expander; and a fifth heat exchanger which pre-cools the vapor stream supplied from the first phase separator via the first heat exchanger by indirect heat exchange with expanded refrigerant stream passed through the third heat exchanger.

Preferably, the connecting line includes: a pipe P1 that is connected continuously through the first, second, third and fourth heat exchangers so as to transfer natural gas, a pipe P2 that is connected from the vapor-phase portion of the first phase separator to the first heat exchanger and from the first heat exchanger via the fifth heat exchanger to the second phase separator so as to transfer the vapor stream supplied from the first phase separator, a pipe P3 that is connected from the liquid-phase portion of the first phase separator via the first heat exchanger to the external compressor so as to transfer the liquid stream supplied from the first phase separator, a pipe P4 that is connected from the vapor-phase portion of the second phase separator to the second heat exchanger and from the second heat exchanger to the turbine expander so as to transfer the liquid stream supplied from the second phase separator, a pipe P5 that is connected from the turbine expander sequentially via the fourth, third and fifth heat exchangers to one end of the pipe P3, and a pipe P6 that is connected from the liquid-phase portion of the second phase separator to the third heat exchanger and the fourth heat exchanger so as to transfer the liquid stream supplied from the second phase separator.

Preferably, the first JT valve for expanding the liquid stream supplied from the first phase separator is arranged on pipe P3 in the place adjacent to the liquid-phase portion of the first phase separator.

Preferably, the second JT valve for expanding the liquid stream supplied from the second phase separator is arranged on pipe P6 adjacent to the liquid-phase portion of the second phase separator.

In accordance with another aspect of the present invention, there is provided a liquefaction method of natural gas comprising the steps of: compressing mixed refrigerants by a compressor to provide compressed refrigerant stream; separating the compressed refrigerant stream into vapor phase and liquid phase refrigerant streams (i.e. vapor and liquid streams) by at least one phase separator; expanding the liquid stream from the phase separator into cold refrigerant by at least one throttling valve to provide expanded refrigerant stream; converting the vapor stream in a saturated state separated from the second phase separator into a refrigerant stream in a superheated state; converting the refrigerant in a superheated state into an expanded-cold refrigerant stream by turbine expander; and cooling the natural gas by indirect heat exchange with the expanded refrigerant stream supplied from the expanded valves and the turbine expander.

Preferably, the cooling step comprises: a first step of cooling the natural gas supplied from a natural gas source and a vapor stream supplied from the separating step by indirect heat exchange with the expanded refrigerant stream of the expanding step in a first heat exchanger; a second step of further cooling the cooled natural gas from the first cooling step by indirect heat exchange with the vapor stream supplied from the separating step in a second heat exchanger; a third step of further cooling the cooled natural gas from the second cooling step by indirect heat exchange with the expanded-cold refrigerant stream passed through the expanding step and an expanded refrigerant stream that is supplied from a turbine expander in a third heat exchanger. a fourth step of further cooling the cooled natural gas from the third cooling step by indirect heat exchange with the expanded refrigerant stream supplied from the turbine expander in a fourth heat exchanger; and a pre-cooling step of the vapor stream supplied from the separating step by indirect heat exchange with expanded refrigerant stream supplied from the third cooling step in a fifth heat exchanger.

According to the natural gas liquefaction system of the present invention using mixed refrigerant with the turbine expander has an effect of increasing the efficiency of the whole refrigeration cycle by using the turbine expander, instead of the throttling process using the conventional Joule-Thomson throttling valve as a final throttling means in the conventional natural gas liquefaction system.

BRIEF DESCRIPTION OF THE DRAWINGS

These and other features, aspects, and advantages of the present invention will be more fully described in the following detailed description of preferred embodiments and examples, taken in conjunction with the accompanying drawings. In the drawings.

DETAILED DESCRIPTION

Hereinafter, the present invention will be described with reference to the accompanying drawings.

Prior to this, terms or words used in the specification and claims should not be construed as limited to a lexical meaning, and should be understood as appropriate notions by the inventor based on that he/she is able to define terms to describe his/her invention in the best way to be seen by others. Therefore, embodiments and drawings described herein are simply exemplary and not exhaustive, and it will be understood that various modifications and equivalents may be made to take the place of the embodiments.

Figure 1:
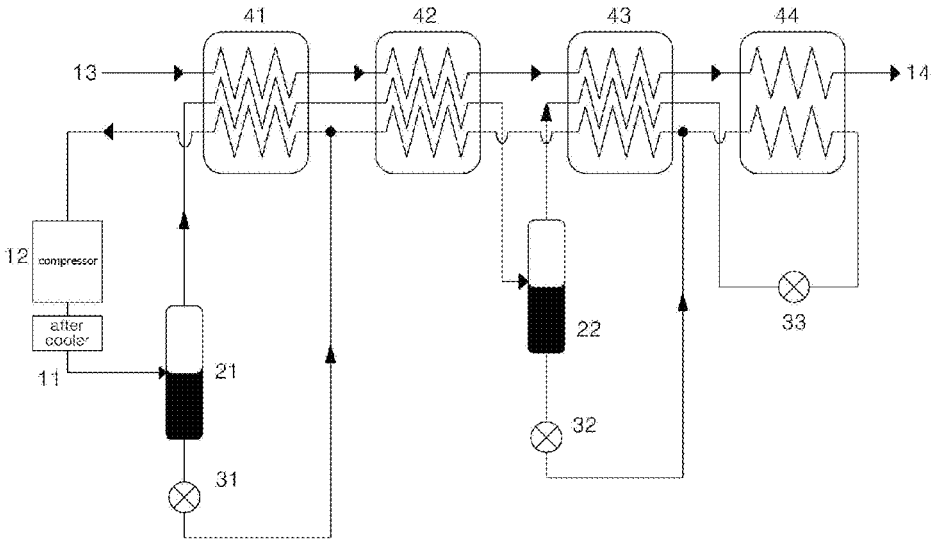
FIG. 1 is a schematic view showing a conventional natural gas liquefaction system.
Figure 2:
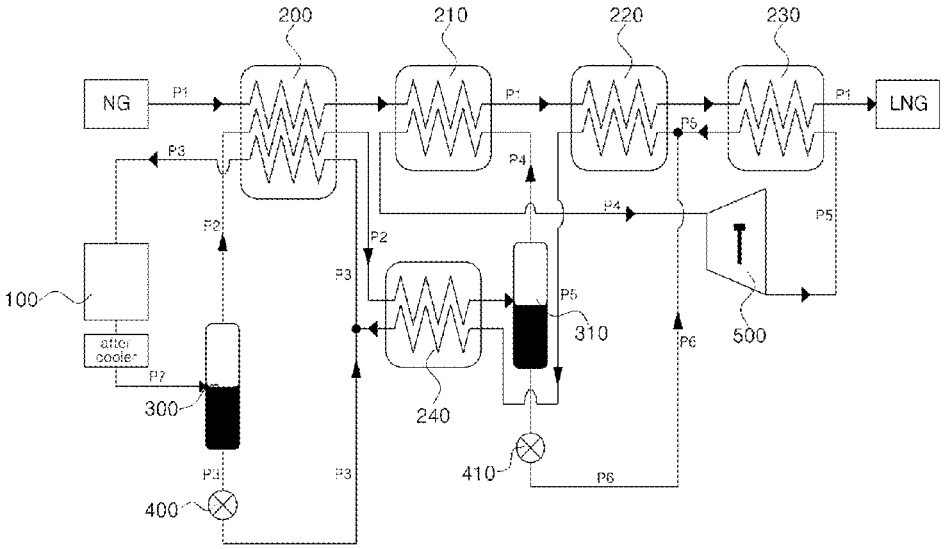
FIG. 2 is a schematic view showing a natural gas liquefaction system with a turbine expander according to one embodiment of the present invention.

FIG. 2 is a schematic view showing a natural gas liquefaction cycle with a turbine expander according to one embodiment of the present invention.

As shown in FIG. 2, the natural gas liquefaction cycle using the turbine expander of the present invention comprises a compressor 100, at least one vapor-liquid separator 300 or 310, a plurality of heat exchangers 200, 210, 220, 230 and 240, at least one Joule-Thomson throttling valve (below to be called JT valve) 400 or 410, a turbine expander 500, and connecting lines composed of a plurality of pipes P1, P2, P3, P4, P5, P6 and P7 to connect these components.

The compressor 100 compresses a mixed refrigerant to provide a compressed refrigerant stream. The compressed refrigerant stream is supplied to a first phase separator 300 via the pipe P7 connected on one side thereof. Since the compressor 100 is of the same structure and configuration as the generally used compressor in related art, specific description is omitted.

In the present invention, the vapor-liquid separator comprises the first phase separator 300 and the second phase separator 310, which separate the compressed refrigerant stream from the compressor 100 into vapor phase and liquid phase refrigerant streams and store them therein. Since the first and second phase separators 300 and 310 are also of the same structure and configuration as the generally used vapor-liquid separators in related art, specific description is omitted.

In the present invention, the JT valve comprises a first JT valve 400 and a second JT valve 410, which play a role of expanding the liquid stream separated by the first and second phase separators 300 and 310 and supplying them to one of the heat exchangers for cooling natural gas, and are connected to the first and second phase separators 300 and 310 by pipes P3 and P6, respectively. At this time, since the JT valves 400 and 410 are of the same structure and configuration of JT valves in related art that expand liquid stream and supply expanded refrigerant stream, specific description is omitted.

The turbine expander 500 used in the present invention plays a role of expanding the vapor stream in a superheated steam state supplied from the second phase separator 310 by indirect heat exchange through a third heat exchanger 220 and supplying the expanded refrigerant stream to a fourth heat exchanger 230 to cool the natural gas.

If a refrigerant in a saturated steam state is flowed into the turbine expander 500, the refrigerant in the turbine expander 500 becomes in a two phase state, so the efficiency thereof decreases abruptly and it becomes a cause for reducing the life. So the refrigerant in a saturated state that flows out from the second phase separator 310 is converted into a superheated state as it is heated while it passes through a second heat exchanger 210, and the refrigerant in a superheated state is flowed into the turbine expander 500, so that the above-mentioned problem can be prevented.

As described above, in the natural gas liquefaction system provided with the turbine expander according to the present invention, the mixed refrigerant compressed by the compressor 100 is separated into vapor phase and liquid phase refrigerant streams (i.e. vapor and liquid streams) in the first phase separator 300 for the first time, and the vapor stream supplied from the first phase separator 300 is separated into vapor phase and liquid phase refrigerant streams in the second phase separator 310 for the second time.

The expanded refrigerant stream supplied from the first phase separator 300 passes through the first heat exchanger 200 to cool the natural gas (NG) and the vapor stream supplied from the first phase separator 300 by indirect heat exchange therewith, then it returns to the low-pressure portion (not shown) of the compressor 100. Meanwhile, the vapor stream supplied from the first phase separator 300 is pre-cooled by the expanded refrigerant stream supplied from the first JT valve 400 as it passes through the first heat exchanger 200, before it is supplied to the second phase separator 310 via a fifth heat exchanger 240 to be again separated into vapor phase and liquid phase refrigerant streams.

The liquid stream supplied from the second phase separator 310 is expanded to cold refrigerant through the second JT valve 410 in the same manner as the first JT valve 400 to provide an expanded refrigerant stream. Then, the expanded refrigerant stream cools natural gas by indirect heat exchange as it passes through the third heat exchanger 220 and returns to the compressor 12 via the fifth and first heat exchanger 240 and 200 in sequence. Meanwhile, the vapor stream supplied from the second phase separator 310 is flowed into the turbine expander 500 via the second heat exchanger 210, then again expanded to cold refrigerant before it is supplied to the fourth heat exchangers 230. Such a series of the natural gas cooling process by indirect heat exchange are made by the plurality of heat exchangers 200, 210, 220, 230 and 240.

Namely, the plurality of heat exchangers 200, 210, 220, 230 and 240 play a role of cooling the natural gas supplied from a natural gas source through indirect heat exchange with the expanded-cold refrigerant stream. The preferred embodiment of the present invention includes the first, second, third, fourth and fifth heat exchangers 200, 210, 220, 230 and 240, but the present is not particularly limited thereto.

Below will be described the indirect heat exchange process of refrigerant made respectively in the first to fifth heat exchangers 200, 210, 220, 230 and 240.

The first heat exchanger 200 cools the natural gas supplied from the natural gas source and the vapor stream supplied from the first phase separator 300 by indirect heat exchange with the expanded-cold refrigerant stream passed through the first JT valve 400. The second heat exchanger 210 further cools the cooled natural gas from the first heat exchanger 200 by indirect heat exchange with the vapor stream supplied from the second phase separator 310. The third heat exchanger 230 further cools the cooled natural gas from the second heat exchanger 210 by indirect heat exchange with the expanded-cold refrigerant stream passed through the second JT valve 410 and the expanded refrigerant stream that is supplied from the turbine expander 500.

The fourth heat exchanger 230 is arranged between the turbine expander 500 and the third heat exchanger 220, and further cools the cooled natural gas from the third heat exchanger 220 by indirect heat exchange with the expanded refrigerant stream supplied from the turbine expander 500. The fifth heat exchanger 240 pre-cools the vapor stream supplied from the first phase separator 300 via the first heat exchanger 200 by indirect heat exchange with expanded refrigerant stream passed through the third heat exchanger 220.

Next will be described a plurality of connecting lines for fluid-tight connecting the first, second, third, fourth and fifth heat exchangers 200, 210, 220, 230 and 240, the first and second phase separators 300 and 310, the first and second JT valves 400 and 410, and the compressor 100.

The connecting lines for transferring fluid i.e. the mixed refrigerants and the natural gas include the pipe P1 that is connected continuously through the first, second, third and fourth heat exchangers 200, 210, 220 and 230 so as to transfer natural gas; the pipe P2 that is connected from the vapor-phase portion of the first phase separator 300 to the first heat exchanger 200 and from the first heat exchanger 200 via the fifth heat exchanger 240 to the second phase separator 310 so as to transfer the vapor stream supplied from the first phase separator 300; the pipe P3 that is connected from the liquid-phase portion of the first phase separator 300 via the first heat exchanger 200 to the external compressor 100 so as to transfer the liquid stream supplied from the first phase separator 300; the pipe P4 that is connected from the liquid-phase portion of the second phase separator 310 to the second heat exchanger 210 and from the second heat exchanger 210 to the turbine expander 500 so as to transfer the liquid stream supplied from the second phase separator 310; the pipe P5 that is connected from the turbine expander 500 sequentially via the fourth, third and fifth heat exchangers 230, 220 and 240 to one end of the pipe P3; and the pipe P6 that is connected from the vapor-phase portion of the second phase separator 310 to the third heat exchanger 220 and the fourth heat exchanger 230 so as to transfer the liquid stream supplied from the second phase separator 310.

At this time, the first JT valve 400 for expanding the liquid stream supplied from the first phase separator 300 is arranged on the pipe P3 adjacent to the liquid portion of the first phase separator 300, and the second JT 410 valve for expanding the liquid stream from the second phase separator 310 is arranged on the pipe P6 adjacent to the liquid portion of the second phase separator 310.

Below will be described with reference to FIG. 2 the method for liquefying natural gas by using a mixed refrigerant in the liquefaction system provided with the turbine expander described above.

First, the mixed refrigerant is compressed by the compressor 100, and the compressed refrigerant stream is supplied to the first phase separator 300 via the pipe P7, and then it is separated into vapor phase and liquid phase refrigerant streams in the first phase separator 300. Next, the liquid stream separated by the first phase separator 300 is expanded through the first JT valve 400 and converted into a low temperature refrigerant, and then the expanded refrigerant stream is transferred to the first heat exchanger 200 via the pipe P3. The first heat exchanger 200 cools the natural gas supplied from the natural gas source via the pipe P1 by indirect heat exchange with the expanded refrigerant stream passed through the first JT valve 400 via the pipe P3. The cooled natural gas is transferred to the next second heat exchanger 210, and the liquid stream that is indirectly heat exchanged as it passes through the first heat exchanger 200 returns to the low-pressure portion (not shown) of the compressor 100 via the pipe P3 again.

Meanwhile, the vapor stream supplied from the first phase separator 300 is pre-cooled by indirect heat exchange with the expanded refrigerant stream in the process of passing the first heat exchanger 200 and the fifth heat exchanger 240 in sequence via the pipe P2, and the pre-cooled refrigerant is transferred to the second phase separator 310 to be separated again into vapor phase and liquid phase refrigerant streams.

Here, the liquid stream separated from the second phase separator is sent to the second heat exchanger 210 via the pipe P4, and then is indirectly heat exchanged with the natural gas from the first heat exchanger 200 before it is transferred to the turbine expander 500. At this time, the vapor stream is indirectly heat exchanged with the cooled natural gas that passes through the second heat exchanger 210, so that the vapor stream in a saturated state is converted into a refrigerant stream in a superheated state, then flowed into the turbine expander 500. Therefore, it is possible to prevent the decreased efficiency and the shortened lifespan of the turbine expander 500 due to an abnormal state that could happen in case the refrigerant in a saturated state is flowed into the turbine expander 500.

And the low-pressure refrigerant that has passed through the turbine expander 500 passes through the fourth heat exchanger 230, the third heat exchanger 220 and the fifth heat exchanger 240 in sequence via the pipe P5 for regeneration of the remaining cold source to be cooled by indirect heat exchange with refrigerant and natural gas before it returns to the compressor 100 via the pipe P3. At this time, one end of the pipe P5 is connected to the pipe P3 that connects the first JT valve 400 and the first heat exchanger 200, and one end of the pipe P3 that is passed through the first heat exchanger 200 is connected to the low-pressure portion of the compressor 100.

Meanwhile, the liquid stream supplied from the second phase separator 310 is expanded through the second JT valve 410, and the expanded refrigerant stream is transferred to the third heat exchanger 220 via the pipe P6 which is connected to the pipe P5. The third heat exchanger 220 further cools the cooled natural gas from the second heat exchanger 210 through indirect heat exchange with the expanded refrigerant stream passed through the second JT valve via the pipe P6 and the expanded refrigerant stream supplied from the turbine expander 500 via the pipe P5. After that, as described above, the refrigerant passes through the fifth and first heat exchangers 240 and 200 in sequence via the pipes P5 and P3 to pre-cool the vapor streams before it returns to the compressor 100 via the pipe P3.

The cooled natural gas from the third heat exchanger 220 is indirectly heat exchanged in the fourth heat exchanger 230 with the expanded refrigerant stream supplied from the turbine expander 500 via the pipe P5 so as to be converted into the liquefied natural gas (LNG), thereby the natural gas liquefaction cycle using mixed refrigerant is completed. The liquefied natural gas from the fourth heat exchanger 230 is transferred and stored in a liquefied natural gas tank or reservoir via the pipe 1.

While the present invention has been described with reference to the preferred embodiments, it will be understood by those skilled in the related art that various modifications and variations may be made therein without departing from the scope of the present invention as defined by the appended claims.

What is claimed is:

1. A liquefaction system for converting natural gas into liquefied natural gas by using mixed refrigerants, comprising:

a compressor for providing a compressed refrigerant stream by compressing the mixed refrigerants;

first and second phase separators for separating the compressed refrigerant stream transferred from the compressor into vapor phase and liquid phase refrigerant streams (i.e. vapor and liquid streams);

a turbine expander for converting the vapor stream in a superheated state into an expanded-cold refrigerant stream;

a plurality of heat exchangers connected by connecting lines to the first and second phase separators, the turbine expander, a natural gas source and a liquefied natural gas tank so as to cool the natural gas by indirect heat exchange with the expanded refrigerant stream provided by the first and second phase separators and the turbine expander;

first and second JT valves that provide expanded refrigerant stream by expanding liquid stream from the first and second phase separators, respectively, wherein the expanded refrigerant stream converted to a low temperature by the first and second JT valves is supplied to one of the plurality of heat exchangers connected to the first and second JT valves so as to cool the natural gas by indirect heat exchange, wherein the plurality of heat exchangers includes:

a first heat exchanger which cools the natural gas supplied from the natural gas source and the vapor stream supplied from the first phase separator by indirect heat exchange with the expanded-cold refrigerant stream passed through the first JT valve;

a second heat exchanger which further cools the cooled natural gas from the first heat exchanger by indirect heat exchange with the vapor stream supplied from the second phase separator;

a third heat exchanger which further cools the cooled natural gas from the second heat exchanger by indirect heat exchange with the expanded-cold refrigerant stream passed through the second JT valve and the expanded refrigerant stream that is supplied from the turbine expander;

a fourth heat exchanger which is arranged between the turbine expander and the third heat exchanger, and further cools the cooled natural gas from the third heat exchanger by indirect heat exchange with the expanded refrigerant stream supplied from the turbine expander; and a fifth heat exchanger which pre-cools the vapor stream supplied from the first phase separator via the first heat exchanger by indirect heat exchange with expanded refrigerant stream passed through the third heat exchanger;

wherein the connecting line includes:

a pipe (P1) that is connected continuously through the first, second, third and fourth heat exchangers so as to transfer natural gas, a pipe (P2) that is connected from the vapor-phase portion of the first phase separator to the first heat exchanger and from the first heat exchanger via the fifth heat exchanger to the second phase separator so as to transfer the vapor stream supplied from the first phase separator, a pipe (P3) that is connected from the liquid-phase portion of the first phase separator via the first heat exchanger to the external compressor so as to transfer the liquid stream supplied from the first phase separator, wherein the first JT valve for expanding the liquid stream supplied from the first phase separator is arranged on pipe (P3) in the place adjacent to the liquid-phase portion of the first phase separator, a pipe (P4) that is connected from the vapor-phase portion of the second phase separator to the second heat exchanger and from the second heat exchanger to the turbine expander so as to transfer the vapor stream supplied from the second phase separator, a pipe (P5) that is connected from the turbine expander sequentially via the fourth, third and fifth heat exchangers to one end of the pipe (P3), and a pipe (P6) that is connected from the liquid-phase portion of the second phase separator to the pipe (P5) between the third heat exchanger and the fourth heat exchanger so as to transfer the liquid stream supplied from the second phase separator, wherein the second JT valve for expanding the liquid stream supplied from the second phase separator is arranged on pipe (P6) adjacent to the liquid-phase portion of the second phase separator.

2. A liquefaction method of natural gas comprising the steps of:

compressing mixed refrigerants by a compressor to provide compressed refrigerant stream;

separating the compressed refrigerant stream into vapor phase and liquid phase refrigerant streams (i.e. vapor and liquid streams) by at least one phase separator;

expanding the liquid stream from the phase separator into cold refrigerant by at least one throttling valve to provide expanded refrigerant stream;

converting the vapor stream in a saturated state separated from the second phase separator into an expanded refrigerant stream in a superheated state;

converting the refrigerant in a superheated state into an expanded-cold refrigerant stream by turbine expander; and cooling the natural gas by indirect heat exchange with the expanded refrigerant stream supplied from the expanded valves and the turbine expander, wherein the cooling the natural gas comprises;

a first step of cooling the natural gas supplied from a natural gas source and a vapor stream supplied from the separating step by indirect heat exchange with the expanded refrigerant stream of the expanding step in a first heat exchanger;

a second step of further cooling the cooled natural gas from the first cooling step by indirect heat exchange with the vapor stream supplied from the separating step in a second heat exchanger;

a third step of further cooling the cooled natural gas from the second cooling step by indirect heat exchange with the expanded-cold refrigerant stream passed through the expanding step and an expanded refrigerant stream that is supplied from a turbine expander in a third heat exchanger;

a fourth step of further cooling the cooled natural gas from the third cooling step by indirect heat exchange with the expanded refrigerant stream supplied from the turbine expander in a fourth heat exchanger; and a pre-cooling step which re-cools the vapor stream su lied from the separating step by indirect heat exchange with expanded refrigerant stream supplied from the third cooling step in a fifth heat exchanger.

* * * * *